United States Patent [19]

Wendt et al.

[11] Patent Number: 4,464,875

[45] Date of Patent: Aug. 14, 1984

[54] WALL PANEL BRACING RIB AND WALL CONSTRUCTED THEREWITH

[75] Inventors: Alan C. Wendt, Barrington; David Krakowski, Deerfield, both of Ill.

[73] Assignee: Unites States Gypsum Company, Chicago, Ill.

[21] Appl. No.: 420,183

[22] Filed: Sep. 20, 1982

[51] Int. Cl.[3] ..... E04B 2/30

[52] U.S. Cl. ..... 52/481; 52/344; 52/715

[58] Field of Search ..... 52/481, 353, 347, 781, 52/714, 715, 344

[56] References Cited

U.S. PATENT DOCUMENTS

| | | | |
|---|---|---|---|
| 734,781 | 7/1903 | Walker et al. | 52/347 |
| 1,368,699 | 2/1921 | Collins | 52/353 |
| 3,125,193 | 3/1964 | Brown et al. | 52/781 |
| 3,740,918 | 6/1973 | Meyer | 52/312 |

FOREIGN PATENT DOCUMENTS

| | | | |
|---|---|---|---|
| 2467927 | 5/1981 | France | 52/714 |
| 387225 | 2/1933 | United Kingdom | 52/353 |

OTHER PUBLICATIONS

"Movable Steel Partitions" advertising brochure by Penn Metal Co., Inc., pp. 4 & 9, Jul. 1962.

"Gypsum Construction Handbook", p. 229, United States Gypsum Co., 1980.

*Primary Examiner*—James L. Ridgill, Jr.

*Attorney, Agent, or Firm*—Robert M. Didrick; Samuel Kurlandsky; Robert H. Robinson

[57] ABSTRACT

The kerfed edges of wall panels attached to H-studs by engagement of the stud flanges within the kerfs are protected against breakage by panel bracing ribs installed within the wall cavity by insertion of the ribs into apertures located in the webs of the studs. Said ribs are bowed wafers of plastic or other flexible material having a notched tab at each end. Insertion of the vertically oriented tabs into said apertures and rotation of the bow to orient said tabs horizontally secures the bracing rib to the stud.

8 Claims, 10 Drawing Figures

WALL PANEL BRACING RIB AND WALL CONSTRUCTED THEREWITH

This invention relates to a wall structure in which building panels are fastened to the upright studs of the framework in and around a building. More particularly, it relates to hollow wall structures in which the wall panels are subject to stud-line fracture upon impact. Included among such panels are gypsum wallboard, the so-called cement board which is generally a lightweight concrete panel, and acoustical wall boards made from wood fibers or mineral fibers.

The area of a wall panel which is adjacent the edge of the stud to which the panel is fastened undergoes considerable stress when the face of the panel is subjected to severe accidental or intentional blows. The edge of the panel is secured to and supported by the stud but the area right next to the stud is subject to strong flexural strains when all but the edge of the panel flexes under impact.

A kerfed-edge panel attached to a stud by the engagement of spline-like stud flanges within the kerf is particularly prone to stud-line fracture.

Impact resistance is a very desirable characteristic to be considered in the selection of building panels. However, it sometimes happens that other characteristics of the panel, such as sound absorption or finished appearance, outweigh the importance of impact resistance. In such circumstances, special precautions must be prescribed for activities near the wall or special modes of construction must be followed.

It is an object of this invention to provide an abuse resistant wall structure.

It is a related object of this invention to provide a panel bracing rib for installation within the wall cavity to absorb the flexural strain within an impacted wall panel and distribute these forces within the wall structure.

It is another related object of this invention to provide a method for the construction of an abuse resistant paneled hollow wall structure.

These and other objects which will become apparent from the following drawings and description are achieved by a wall structure which comprises:

a framework of vertical studs disposed between a top plate and a sole plate in co-planar array, each of which studs comprises a web member and at least one pair of flanges connected to said web at right angles thereto, said web having an aperture therein whose centerline is congruent with the vertical centerline of the web.

a wall panel attached to the flanges of said studs; and a wall panel bracing rib secured to said web in edge-abutting relationship to the interior surface of said panel, said rib comprising a bowed wafer of flexible material and said wafer being of elongate, generally rectangular shape and having a tab, integral with and co-planar with said wafer, at each of the narrow ends of said wafer, each said tab having a pair of opposing notches cut into its periphery at the juncture of said tab and said wafer; the bow being such that the two tabs project through the web aperture and engage the vertical edges of the aperture.

Turning now to the drawings.

Figure 1:
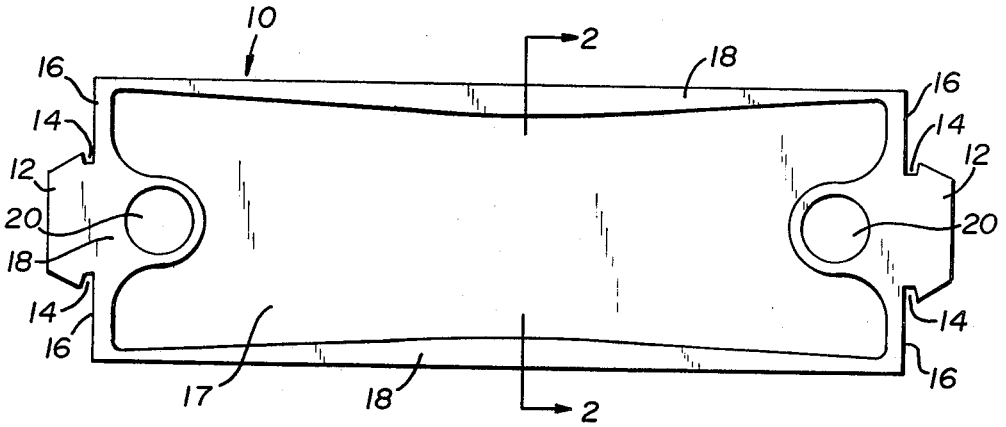
FIG. 1 is a plan view of a flexible wafer of this invention, being adapted for bending into a bow for use as a panel bracing rib.
Figure 4:
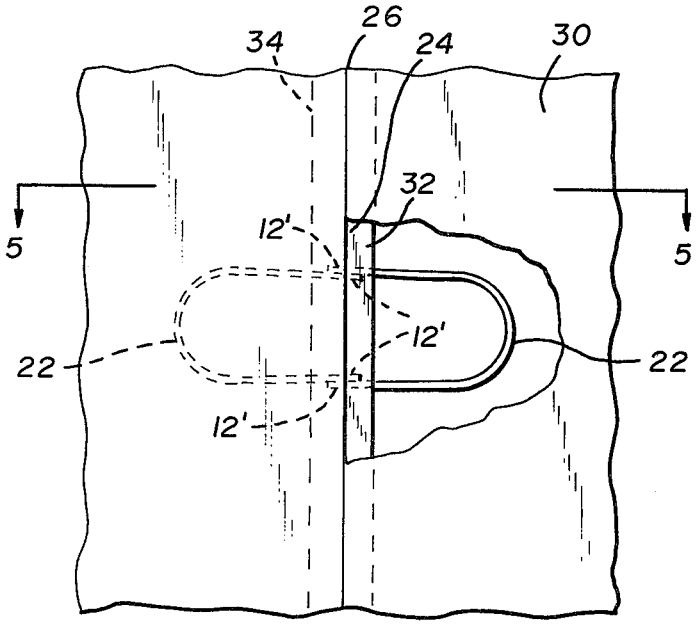
FIG. 4 is an elevational view, also partially cut away, of said wall structure.
Figure 5:
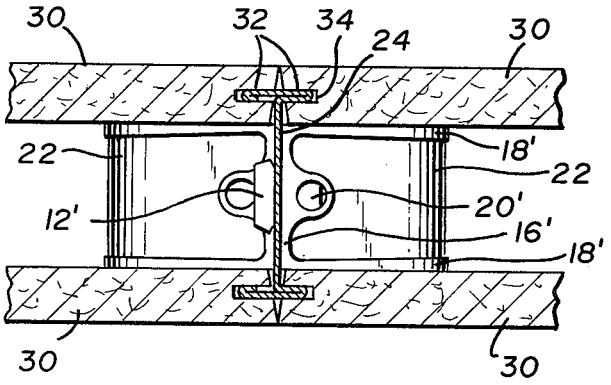
FIG. 5 is a cross-section of said wall structure, taken along line 5—5 of FIG. 4.

In FIG. 1, the wafer 10 has a pair of tabs 12 which have notches 14 cut into them where said tabs meet the shoulders 16 of the wafer. The main body 17 of the wafer and the tabs may be extruded or injection molded as a unit from a thermoplastic material. The size of the wafer and tabs is not critical although the desired flexibility does limit the thickness somewhat. An exemplary wafer may be from about 5 to about 7 inches long from shoulder to shoulder and the body 17 may be about 0.04 inch thick. The width of the wafer is chosen so that it will just fit within the cavity of the hollow wall. Each tab protrudes about 0.3 inch from its adjacent shoulder and is about 1 inch across at its widest span. The tabs are about 0.08 inch thick. The wafer may be bent into a bow such that the tabs are superposed with respect to each other. To foster a smooth curvature of the wafer into a bow rather than a sharp crimping thereof, the flexural strain in the bent wafer is diffused by the beads 18 which are integral with the wafer. The shoulders 16 are of substantially the same thickness as the tabs 12. As shown, the width of the beads 18 increases from a minimum at each end to a maximum at the mid-point. Their thickness may vary in like manner from that of the shoulders to a maximum at mid-point. Fingerholes 20 are provided for a better grasp of the wafer while it is being bent by hand into a bow and thus being adapted for use as a panel bracing rib 22 in the wall structure of FIGS. 3, 4, and 5.

Figure 3:
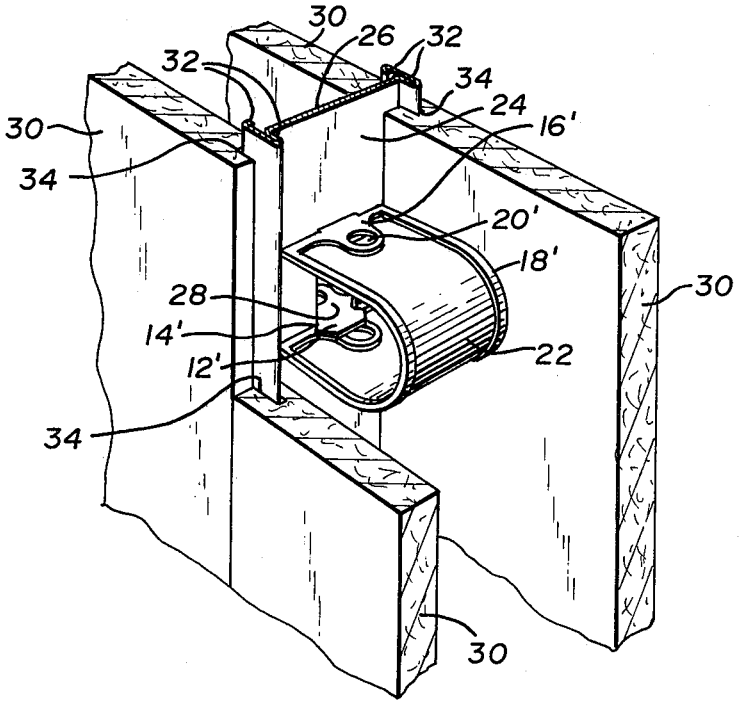
FIG. 3 is a perspective view, partially cut away, of a wall structure of this invention.

The bracing rib 22 is secured to the web 24 of stud 26 in FIG. 3 by the locking engagement of the vertical edges of a rectangular aperture 28 in the web 24 with the notches 14' in the tabs 12' of a panel bracing rib 22, one tab 12' being shown as it projects through the aperture 28 from a rib 22 which, being on the left side of the web 24, is otherwise hidden from view in FIG. 3. Wall panels 30 are fastened to the stud 26 by insertion of the flanges 32 into the kerfs 34 in the edges of said wall panels 30. As can be seen, the beads 18' also reinforce the edges of the rib 22 which abut the interior surfaces of the panels 30.

Figure 6:
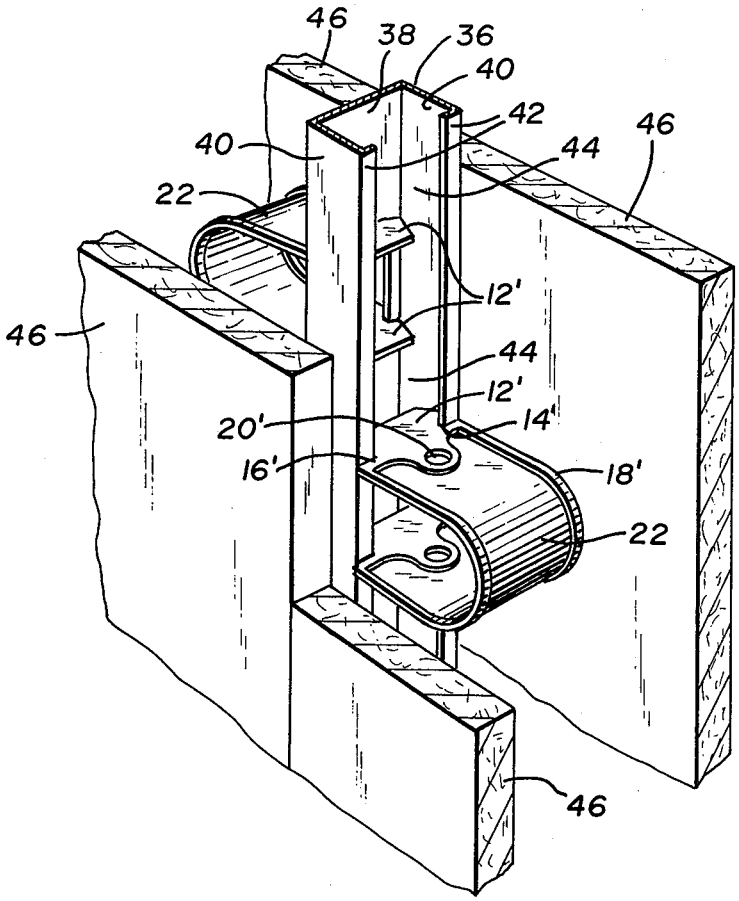
FIG. 6 is a perspective view, partially cut away, of another embodiment of the wall structure of this invention.
Figure 7:
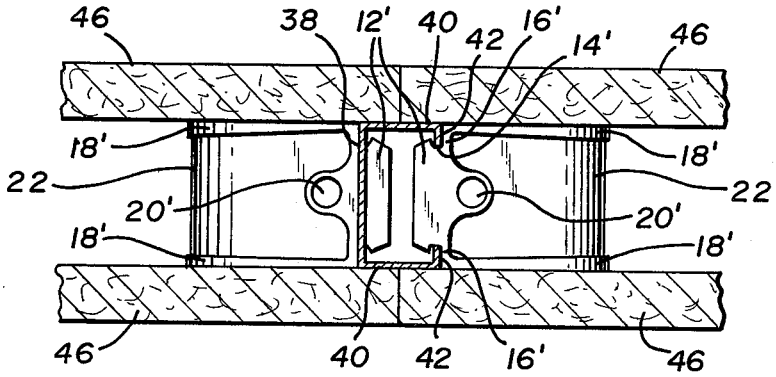
FIG. 7 is a plan view of the wall structure of FIG. 6.

In FIGS. 6 and 7, the panel bracing ribs 22 are secured to a stud 36 consisting of a web 38 and co-directional flanges 40 which have turned-in edges 42. Said turned-in edges 42 define a slot 44 is which a rib 22 is inserted and held in place by the cooperation of said edges 42 and the notches 14' of tabs 12'. Another rib 22 is secured to the other side of web 38 in the same manner as in the wall structure of FIGS. 3–5. Wall panels 46 do not have kerfed edges but are fastened to the stud 36 by any of the conventional means such as an adhesive or screws.

The bracing ribs 22 are shown in FIG. 6 as being part of a staggered series, that is, every second one is on the side opposite the one preceding it. Such an arrangement may also be used when the ribs 22 are secured to the stud 26 of FIGS. 3–5.

Figure 2:
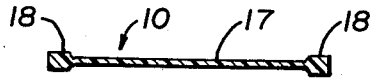
FIG. 2 is a cross-section of the wafer shown in FIG. 1, taken along line 2—2 thereof.
Figure 8:
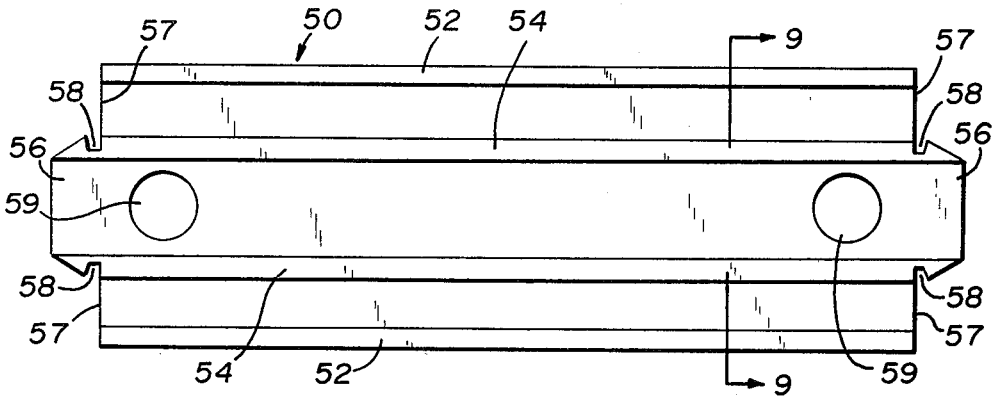
FIG. 8 is a plan view of another embodiment of the wafer of this invention.
Figure 9:
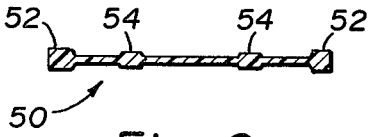
FIG. 9 is a cross-section of the wafer of FIG. 8, taken along line 9—9 thereof.

In FIGS. 8 and 9, the wafer 50 has beads 52, reinforcing strips 54, and tabs 56, all of which are integral with the wafer body. The strips 54 add stiffness and strength to the shoulders 57 and tabs 56 while the beads 52, tabs 56, notches 58 and fingerholes 59 have the same function as their counterparts have in the wafer 10 of FIGS. 1 and 2.

The steps in the construction of the wall structure of this invention are the conventional ones except for the novel step of placing the bracing ribs 22 on the studs. After the top plate and sole plate have been fixed in their proper positions, studs having apertures 28 or slots 44 or both are selected as desired and fastened to said plates. Then, a panel bracing rib 22 is inserted in an aperture or slot by turning said rib to align the tabs 12' with the longer dimension of the opening (e.g., the diagonal of a square aperture), pushing the tabs through the opening, and again turning the rib to mesh the edges of the opening with the notches 14' of the tabs.

The width of the rib is such that it will just span the cavity that is to be created by the attachment of the panels to the studs. Such attachment may be made by kerf engagement with the stud flanges or by screws or an adhesive or any other conventional fastening means. When the panels are fastened in place, the beads 18' of the rib 22 touch lightly the interior surfaces of the panels on opposite sides of the stud.

The panel bracing rib 22 preferably is made by bending the wafer 10 into a bow and inserting it as described above but a rib having a permanent bow in it is also contemplated as part of the wall structure of this invention. Such a permanently bowed rib may be made from sheet metal, a thermosetting resin, fiberboard, or the like. Use of the wafer is preferred because, being thin, flexible and substantially rectangular, it may be easily packaged for shipment and a stack of such wafers is easily carried in a carpenter's pocket or held in one hand as wafer after wafer is bowed and inserted into the stud openings as described above. The wafer is preferably made from a thermoplastic material such as poly(vinyl chloride), polyethylene, or nylon because of its toughness and the easy mass production of such wafers by extrusion or injection molding. However, the wafer and, therefore, the rib, may be made from another flexible material such as cardboard.

Figure 10:
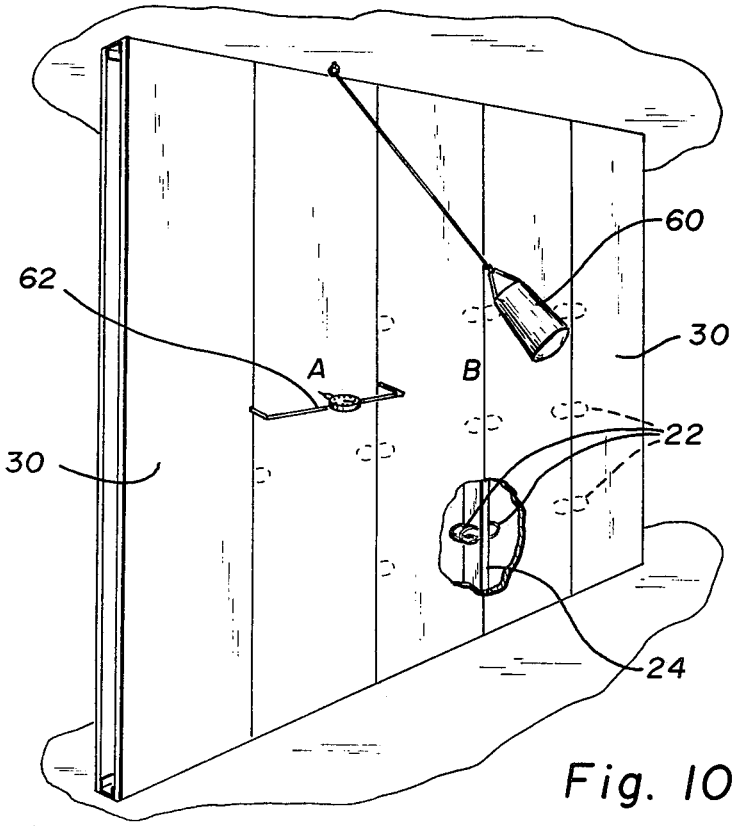
FIG. 10 is a perspective view of a wall structure of this invention as it is being tested for impact resistance.

In FIG. 10, a sandbag 60 is shown as it is being swung in an arc from a specified height to strike an 8'×9' wall constructed according to this invention. The sandbag 60 weighs 60 pounds and meets the specifications of Section 13.2.3 of the ASTM E72 test procedure. The panels 30 are, in this instance, vinyl covered sheets of gypsum measuring 2'×8'×¾". The centers of the impact areas on the panels are indicated by the letters A and B. The studs 26, having ¾" wide by 1½" long apertures in the web, are spaced apart 24" O.C. and the panel bracing ribs 22 are placed as shown. A deflectometer 62 is mounted on adjacent studs 26 before and after each of four drops. The panel face deformation and other observations as to the condition of the panels are given in Table I.

TABLE I

| Impact Area | Drop No. | Impact (ft.-lbs.) | Cumulative Deformation (Inch) | Observations |
|---|---|---|---|---|
| A | 1 | 15 | 0.010 | — |
| A | 2 | 30 | 0.041 | — |
| A | 3 | 45 | 0.062 | — |
| A | 4 | 60 | 0.084 | Crack in core at point of impact |
| B | 6 | 90 | — | Kerf broke on face and at top end of stud on back |

A wall constructed in the same manner as above but without the panel bracing ribs was tested by the same procedure. The results are given in Table II.

TABLE II

| Impact Area | Drop No. | Impact (ft.-lbs.) | Cumulative Deformation (Inch) | Observations |
|---|---|---|---|---|
| A | 1 | 15 | 0.029 | — |
| A | 2 | 30 | 0.049 | — |
| A | 3 | 45 | 0.079 | 18"vertical crack in center of panel |
| A | 4 | 60 | — | Kerfs on back panels broke |
| B | 4 | 60 | — | Top kerfs on back panels broke; wall could be weaker due to previous testing of adjacent panel joint |

A wall having panel bracing ribs was constructed as described above but acoustical panels of fabric covered, water-felted mineral fibers were used instead of the gypsum panels. The panel dimensions were 2'×8'×¾". Some of the kerfs were not centered in the eges of the panels. The wall was tested by the procedure described above and the results are given in Table III.

TABLE III

| Impact Area | Drop No. | Impact (ft.-lbs.) | Cumulative Deformation (Inch) | Observations |
|---|---|---|---|---|
| A | 1 | 15 | 0.077 | — |
| A | 2 | 30 | 0.167 | — |
| A | 3 | 45 | 0.276 | Panel dented but not visible |
| A | 4 | 60 | 0.425 | Panel cracked |
| B | 2 | 30 | — | Kerfs at top of back panels broke |

The above data shows that the impact resistance of a paneled wall is enhanced by the use of the panel bracing ribs of this invention.

Various embodiments of the invention thus illustrated and described may be suggested to one skilled in the art but still be within the spirit and scope of the appended claims.

What is claimed is:

1. A tabbed wafer of flexible material adapted for insertion as a bow into an aperture within the web of a building stud to form a wall panel bracing rib, said wafer having an elongate rectangular shape, an integral, coplanar tab at each of the narrow ends of the rectangle, each said tab having a pair of opposing notches cut into its edge at the juncture of said tab with said wafer, and an integral bead extending along each of the longitudinal edges on both the top and bottom faces of said wafer, the width of each bead varying gradually from a minimum at each end thereof to a maximum at the midpoint thereof.

2. A wall structure comprising:

a plurality of vertical studs spaced apart in co-planar array, each said stud comprising a web and flanges connected at right angles to said web along the opposite vertical edges thereof, said web having a rectangular aperture centered between the margins thereof;

wall panels attached to opposing flanges of said studs, thereby creating a cavity in which said studs reside; and a wall panel bracing rib secured to said web within said cavity in edge-abutting relationship to a wall panel, said rib comprising a 180° bow of bendable material and an integral tab projecting horizontally from each end of said bow and through the aperture within the web, said tabs being notched on opposite edges thereof and thereby being interlocked with the edges of said aperture.

3. A wall structure comprising:

a plurality of vertical studs spaced apart in co-planar array, each of which studs comprising a web and at least one pair of flanges connected to the web at right angles thereto, said web having an aperture therein whose centerline is congruent with the vertical centerline of the web;

a wall panel attached to the flanges of said studs; and a wall panel bracing rib secured to said web in edge-abutting relationship to the interior surface of said panel, said rib comprising an elongate, generally rectangular wafer of flexible material and a tab, integral with and co-planar with said wafer, at each of the narrow ends of said wafer, each said tab having a pair of opposing notches cut into its periphery at the juncture of said tab and said wafer; said wafer being bowed about its lateral centerline so that the two tabs approach each other and project through said aperture and engage said web.

4. The wall structure of claim 3 wherein said wall panel has a kerf within each vertical edge thereof and said studs are H-shaped studs having two pairs of flanges, each pair being connected to one vertical edge of the web and the flanges of each pair being oppositely directed, each flange being inserted in the kerf of a wall panel.

5. The wall structure of claim 3 wherein said wafer has a 180° bow.

6. The wall structure of claim 3 or claim 2 wherein a panel bracing rib is located on each side of the web at each aperture.

7. The wall structure of claim 3 or claim 2 wherein a series of panel bracing ribs are located on alternating sides of the web.

8. The wall structure of claim 2 wherein said flanges are co-directional and have turned-in edges at right angles thereto, said edges defining a slot in which a wall panel bracing rib is inserted and is secured by an interlocking cooperation between the notched tabs of said rib and said turned-in edges.

* * * * *